US006646627B2

(12) United States Patent
Sugiyama

(10) Patent No.: US 6,646,627 B2
(45) Date of Patent: Nov. 11, 2003

(54) LIQUID CRYSTAL DISPLAY CONTROL DEVICES AND DISPLAY APPARATUS FOR CONTROLLING PIXEL DISCRIMINATION

(75) Inventor: Hitoshi Sugiyama, Mihama-ku (JP)

(73) Assignee: Kawasaki Microelectronics, Inc., Chiba (JP)

( * ) Notice: Subject to any disclaimer, the term of this patent is extended or adjusted under 35 U.S.C. 154(b) by 243 days.

(21) Appl. No.: 09/775,658

(22) Filed: Feb. 5, 2001

(65) Prior Publication Data

US 2001/0026256 A1 Oct. 4, 2001

(30) Foreign Application Priority Data

Feb. 3, 2000 (JP) ..... 2000-032671

(51) Int. Cl.[7] ..... G09G 3/36
(52) U.S. Cl. ..... 345/87
(58) Field of Search ..... 345/87, 89, 88, 345/617, 204, 690; 348/616, 617, 618, 619, 441; 382/239

(56) References Cited

U.S. PATENT DOCUMENTS 4,807,033 A * 2/1989 Keesen et al. ..... 348/616
5,394,192 A * 2/1995 Hackett ..... 348/619
5,801,780 A * 9/1998 Schaumont et al. ..... 348/441
6,339,657 B1 * 1/2002 Yamaguchi et al. ..... 382/239

* cited by examiner

*Primary Examiner*—Chanh Nguyen
(74) *Attorney, Agent, or Firm*—Oliff & Berridge, PLC

(57) ABSTRACT

A liquid crystal display, which displays images processed by a liquid crystal display control device, and a liquid crystal display control device are disclosed. The liquid crystal display displays two-dimensional images processed by the liquid crystal display control device, where the influence of surrounding pixels is reduced. A renewed pixel value corresponding to a first pixel is obtained by adding the result of the multiplication of the coefficient and the difference value of the first pixel value and the second pixel value in a computing block.

15 Claims, 7 Drawing Sheets

LIQUID CRYSTAL DISPLAY CONTROL DEVICES AND DISPLAY APPARATUS FOR CONTROLLING PIXEL DISCRIMINATION

BACKGROUND OF THE INVENTION

1. Field of Invention

This invention relates to liquid crystal display control devices and liquid crystal display apparatus.

2. Description of Related Art

The liquid crystal display is becoming popular for it's space saving characteristics and low power consumption in picture display devices. Research on liquid crystal displays is being done actively, and the performance of liquid crystal displays has improved remarkably in recent years.

Liquid crystals have a property of changing their molecular orientation when an electric field is applied. A vertical alignment-type liquid crystal is shown in FIGS. 5(*a*) and 5(*b*). FIG. 5(*a*) shows a liquid crystal of a vertical alignment-type liquid crystal when an electric field is not applied. FIG. 5(*b*) shows the same liquid crystal when an electric field is applied.

A negative dielectric anisotropic nematic liquid crystal molecule 2, sandwiched between a pair of electrodes 1, is oriented vertically with respect to the pair of electrodes 1 as shown in FIG. 5(*a*) when no voltage is applied to the electrodes 1. When a voltage is applied to the electrodes 1, the orientation of the nematic liquid crystal molecule 2 changes to horizontal relative to the electrode 1 as shown in FIG. 5(*b*). The liquid crystal illustrated in FIGS. 5(*a*) and 5(*b*) is called a vertical alignment type liquid crystal of an electric field effect-type.

Another type of liquid crystal is called a horizontal alignment liquid crystal of an electric field effect type. This type of liquid crystal molecule aligns in the horizontal direction when no voltage is applied to a pair of electrodes. When a voltage is applied to the electrodes, the liquid crystal molecule orientation changes to vertical relative to the electrodes. This type of liquid crystal aligns to an electric field orientation when a voltage is applied to the electrodes.

Liquid crystal displays using above-described electric field effect-type liquid crystal, include a pair of transparent electrodes and a pair of orientation films beneath the inner sides of the electrodes. The orientation film has a plurality of grooves and is arranged such that the directions of the grooves are different by 90 degrees from each other. Polarizing plates are disposed outside the transparent electrodes, respectively. The liquid crystal molecules are oriented by aligning to the grooves of the orientation film in the neighborhood of each orientation film. Between the orientation films, the liquid crystal molecules are twisted continuously by 90 degrees. The pair of polarizing plates controls the beam to pass through or be intercepted. A pair of polarizing plates can be arranged in the same direction, or in 90 degree direction, according to a design of the display apparatus.

Normally black systems employ intercepting beams when no voltage is applied, and passes through the beam when a voltage is applied. In contrast, normally white systems employ intercepting beams when a voltage is applied, and passes through the beam when no voltage is applied.

Presently, liquid crystal displays for notebook computers, normally white system with a horizontal alignment liquid crystal of an electric field effect-type are popular. For a projection display and a television display, it is important to have wide view-angle characteristics, normally black systems are becoming popular with a vertical alignment-type liquid crystal.

Liquid crystal displays are controlled by the supply voltage to an individual pixel. If a fixed voltage is applied to each pixel adopting the normally black system liquid crystal display, a fixed brightness is sure to be obtained on the liquid crystal display. If a fixed voltage is applied to each pixel adopting a normally white system liquid crystal display, a fixed darkness is sure to be obtained on the liquid crystal display. However, even if a fixed voltage is applied to a pixel, the brightness or the darkness of the pixel is not constant due to the effect of the darkness or the brightness of the surrounding pixels. In other words, the brightness or the darkness of a pixel is affected by voltages applied to the surrounding pixels. The phenomenon of having non-constant brightness or darkness regardless of the same supply voltage is called discrimination.

Recently, the size of pixels of liquid crystal displays has become smaller and smaller. As a result, controlling discrimination is becoming more important in order to obtain a good quality liquid crystal display.

FIGS. 6 and 7 show discrimination data measured on a conventional vertical alignment normally black-type liquid crystal display. FIG. 6 shows image patterns for measurements of discrimination. FIG. 7 shows the relationship between an applied voltage and a standardized mean brightness value of a pixel of the image patterns. Each image pattern has eight columns and plural rows and the same voltage is applied to the pixels in the same column. FIG. 6(*a*) is a "1111" pattern. All pixels are applied voltage. FIG. 6(*b*) is a "1110" pattern. Pixels in the left three columns are applied voltage and the pixels in the fourth column are not applied voltage. FIG. 6(*c*) is a "1100" pattern. Pixels in the left two columns are applied voltage and the pixels in the third and forth columns are not applied voltage. FIG. 6(*d*) is named"1000" pattern. Pixels in the first column are applied voltage and the pixels in the second through forth columns are not applied voltage. FIG. 6(*e*) is named"0101" pattern. Pixels in the second and fourth columns are applied voltage and the pixels in the first and third columns are not applied voltage. In this measurement, the brightness of the entire image is measured changing the applied voltage to each pixel.

The processing for measured brightness values of one pixel is standardized as follows. First, the number of pixels to which the voltage is applied is counted for each image pattern. Next, all the measured brightness values of all image patterns are standardized using the highest brightness value. The measured brightness value at 3900 mV voltage of the "1111" pattern is set to be the standard 1.0. Finally, the standardized brightness values are divided by the number of voltage-applied pixels and the standardized brightness value for each image pattern is calculated.

The x-axis in the graph of FIG. 7 is the voltage (mV) applied to a pixel, and the y-axis is the standardized brightness value of the pixel. The mean standardized brightness value of a pixel of the "1111" pattern is plotted by the symbol "◆" in this graph. Also the mean standardized brightness value of a pixel of the "1110" pattern is plotted by the symbol "■", the "1100" pattern is plotted by the symbol "Δ", the "1000" pattern is plotted by the symbol "X", and the "0101" pattern is plotted by the symbol "○".

Originally, the mean standardized brightness value of each pixel is expected to be the same value as that of the "1111" pattern. However, because of discrimination, the mean standardized brightness value of a pattern having non-voltage applied pixels is lower than that of the "1111" pattern when the applied voltage is 200 mV and above.

Moreover, the mean standardized brightness value of the "1100" pattern (FIG. 6(*c*)) is higher than that of the "0101" pattern (FIG. 6(*e*)), even though the total number of voltage applied pixels are equal. The mean standardized brightness value of the "0101" pattern (FIG. 6(*e*)) is almost equal to that of the "1000" pattern (FIG. 6(*d*)), even though the total number of voltage applied pixels are doubled.

It is understood that on a normally black type liquid crystal display, discrimination appears to have an influence of darkening a pixel by surrounding black pixels. Moreover, a pixel to which the voltage is applied is affected by the discrimination largely owing to the number of surrounding pixels to which no voltage applied.

The discrimination in normally black-type liquid crystal displays causes a white character in a black background to look like a thinner and darker character. The discrimination in normally white-type liquid crystal displays causes a black character in a white background to look like a thinner and brownish character. Moreover, because the influence degree of the discrimination is different for each pixel in the color liquid crystal display panel regardless of whether it is a normally black or white type, a pixel that must be originally an achromatic color might be displayed as a chromatic color.

The above-described phenomenon is not limited to a liquid crystal display apparatus. That is, a pixel value of each pixel might also be influenced by surrounding pixels, causing an input pixel value change to a quite different pixel value, in two dimensional image display devices.

SUMMARY OF THE INVENTION

This invention provides liquid crystal display control devices, which reduce influences of surrounding pixels by processing a pixel value. This invention also provides liquid crystal display apparatus, which display images processed by the liquid crystal display control device. In addition, this invention provides spatial filtering methods.

An exemplary embodiment of the liquid crystal display control devices according to this invention include a data input port at which pixel data of a plurality of pixels forming a two-dimensional image is input, and a liquid crystal display control device. The liquid crystal display performs processing and, particularly, associates a first element with a first pixel of the two-dimensional image; associates each of a plurality of second elements with respective ones of a plurality of second pixels surrounding the first pixel of the two-dimensional image; sets a coefficient for each second element, corresponding to a difference value between each second pixel value of each second pixel and a pixel value of the first pixel; multiplies the coefficient set for the second element of each second pixel by the difference value between the second pixel value of each second pixel and the pixel value of the first pixel; adds all of the multiplication results of the plurality of second pixels; generates a new processed pixel value corresponding to the first pixel; and sets the first pixel to one pixel of the plurality of pixels of the two-dimensional image and performs the above processing for each pixel of the two-dimensional image one-by-one.

An exemplary embodiment of the liquid crystal display apparatus according to this invention includes a data input port, an embodiment of the liquid crystal display control devices according to this invention, such as the above-described embodiment, and a display panel that displays the two-dimensional image based on processed pixel data obtained by the liquid crystal display control device.

An exemplary embodiment of the spatial filtering methods according to this invention include determining each difference value of a second pixel value of each of a plurality of second pixels subtracted from a first pixel value of a first pixel; setting a coefficient corresponding to each difference value determined by subtracting the second pixel value of each second pixel from the first pixel value of the first pixel, respectively; multiplying the coefficient set corresponding to each second pixel by the difference value determined by subtracting the second pixel value of each-second pixel from the first pixel value of the first pixel; generating a renewed first pixel value of the first pixel by adding the multiplication results of each of the second pixels; and selecting the first pixel in the two-dimensional image one-by-one.

BRIEF DESCRIPTION OF THE DRAWINGS

The invention will be explained in more detail in conjunction with the appended drawings, wherein.

DETAILED DESCRIPTION OF PREFERRED EMBODIMENTS

Figure 1:
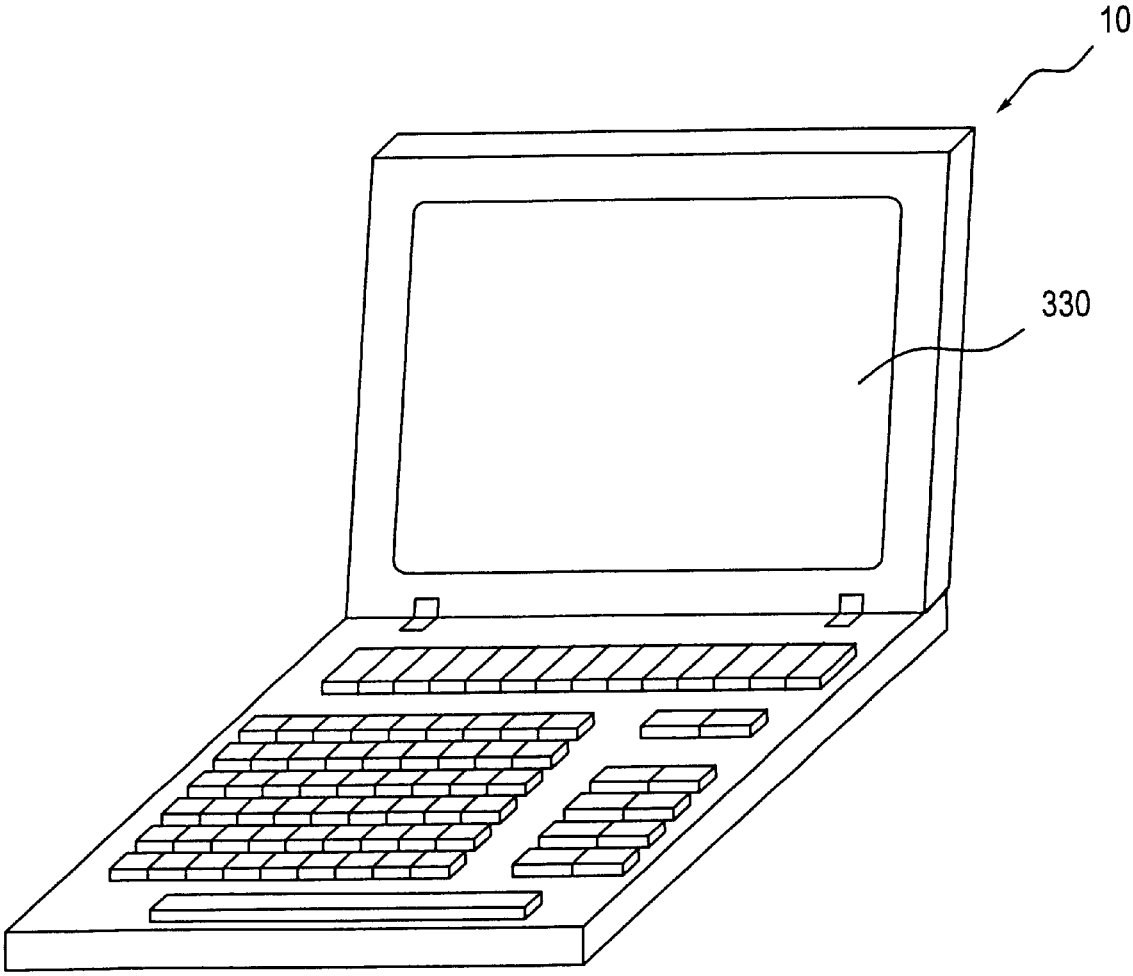
FIG. 1 illustrates a notebook computer.

A notebook computer 10 shown in FIG. 1 includes a vertical alignment-type liquid crystal display panel 330 and a liquid crystal display control device of this invention. The notebook computer 10 has a normally black-type liquid crystal display.

Figure 2:
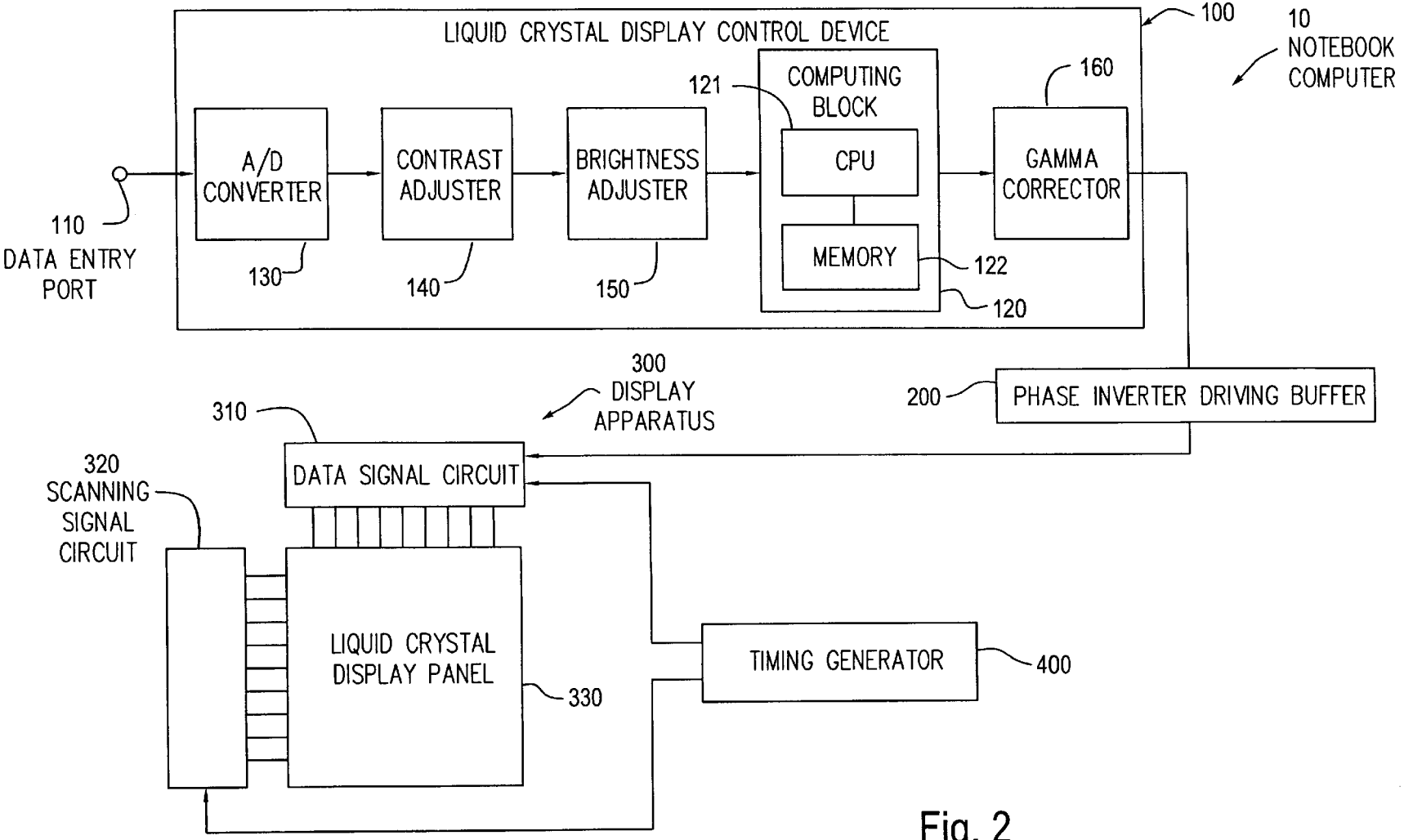
FIG. 2 is a hardware composition diagram of the notebook computer.

FIG. 2 is a fundamental hardware diagram of the notebook computer 10. The notebook computer 10 includes a liquid crystal display control device 100, a phase inverter driving buffer 200, a display 300, and a timing generator 400. The liquid crystal display control device 100 includes a data entry port 110, a computing block 120, an A/D converter 130, a contrast adjuster 140, a brightness adjuster 150 and gamma corrector 160.

Figure 3A:
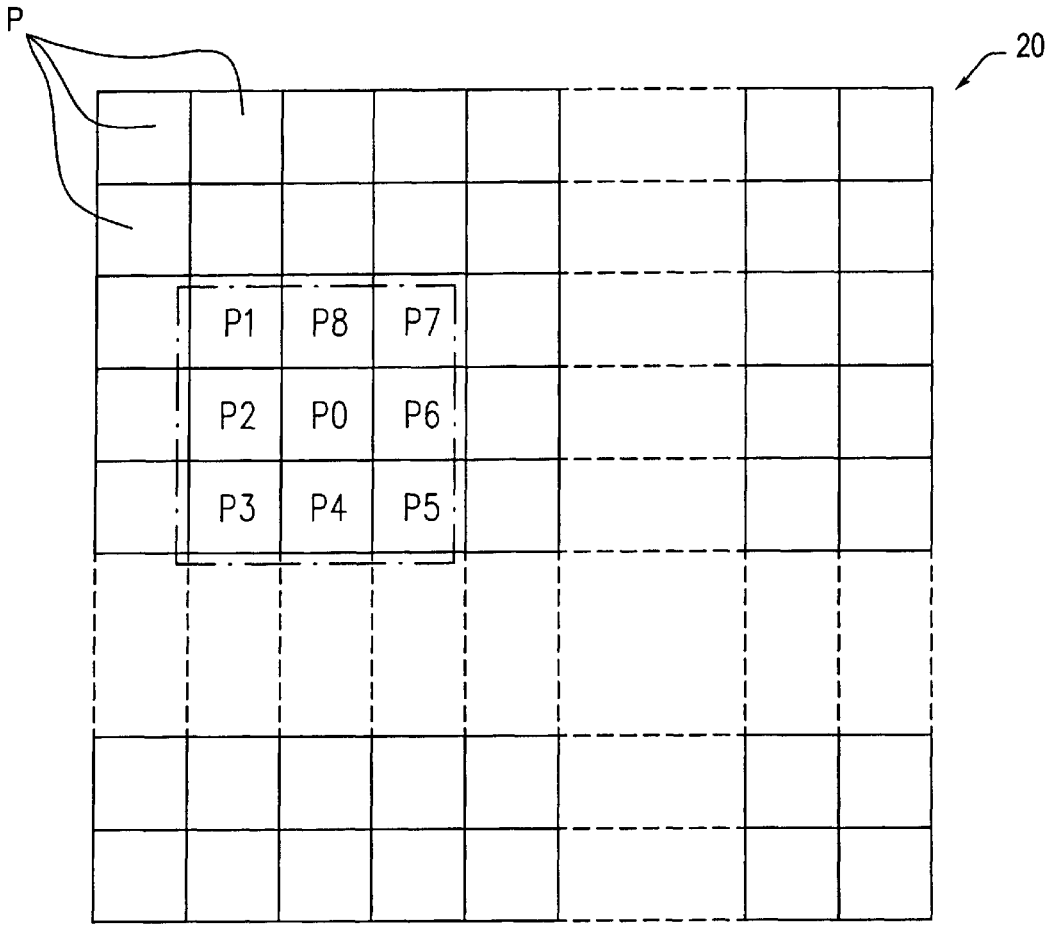
FIGS. 3(*a*) and 3(*b*) show the processed pixel data of a two-dimensional image.
Figure 3B:
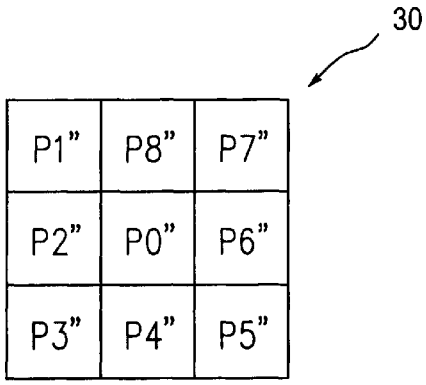

First, pixel data are input through the data entry port 110. A two-dimensional image 20 includes a large number of pixels P arranged in a two-dimensional array as shown in FIG. 3(*a*). Pixel data include primary color signals of R, G and B on each pixel. The input pixel data are converted into digital signals in the A/D converter 130, and contrast adjustment and bright adjustment are processed in the contrast adjuster 140 and the brightness adjuster 150, respectively.

Next, processing according to this invention is performed in the computing block 120. The computing block 120 includes a CPU 121 and a memory 122. Hereafter, the operation processing in the computing block, which is a kind of spatial filtering, will be explained with reference to FIGS. 3(*a*) and 3(*b*). Each pixel P0, P1, . . . through P8 shown in FIG. 3(*a*) has a pixel value P0', P1', . . . through P8', respectively. In this explanation, the pixel value P0' of the pixel P0 is targeted as an object for the operation processing, and P0 is surrounded by pixel P1, P2, . . . through P8 as shown in FIG. 3(*a*).

First, a coefficient, which computing block 120 uses for the operation, is set to each element corresponding to each pixel by using test pixel data. Two kinds of coefficients Kn and Kn' are set respectively corresponding to each element. Kn is a coefficient when discrimination should be considered, and Kn' is a coefficient when it is not necessary to consider discrimination.

The coefficient Kn, which is used when discrimination occurs, is based on pixel data of the test. Kn is set to a positive value by which the white part making contact with the black part becomes brighter while checking the display of the test image on an actual liquid crystal display panel. On the other hand, the coefficient Kn', used when it is not necessary to consider discrimination, is set to zero, or to a much smaller value than Kn. The selected coefficients are memorized in memory 122.

Figure 4:
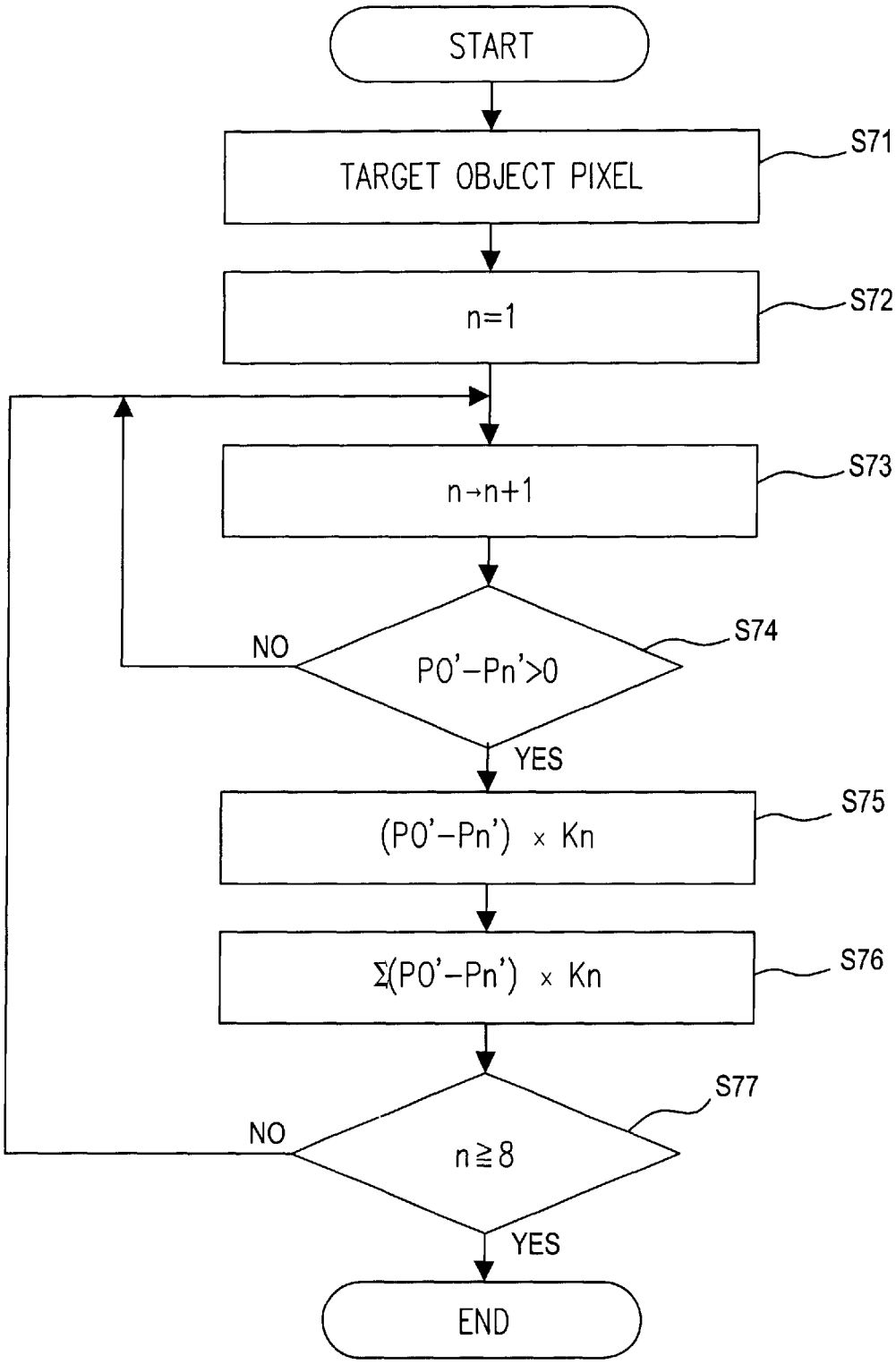
FIG. 4 is a flow chart showing the processing of the computing block.
Figure 5A:
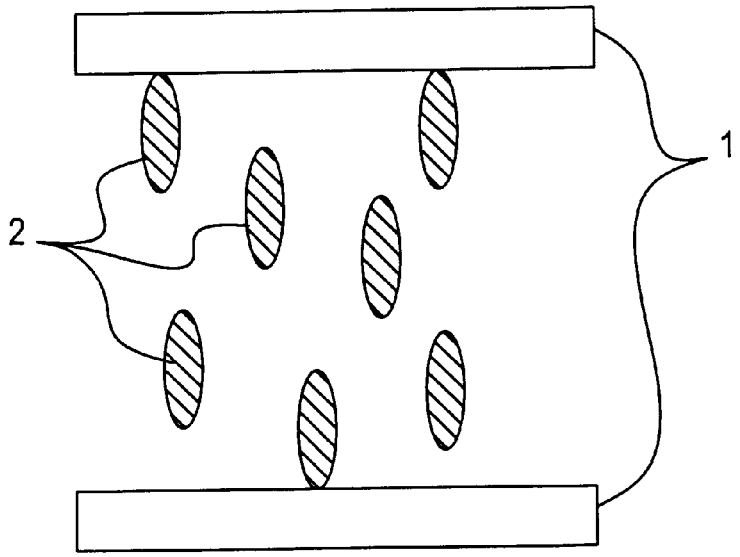
FIGS. 5(*a*) and 5(*b*) show a vertical alignment-type liquid crystal.
Figure 5B:
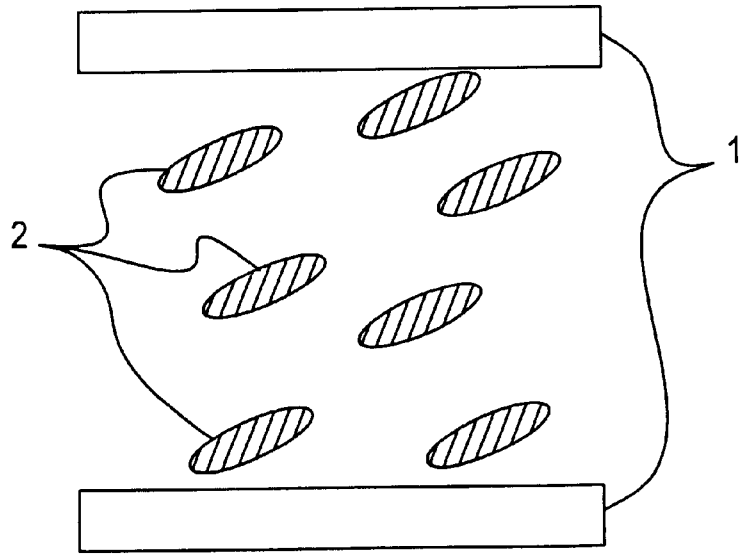
Figure 6A:
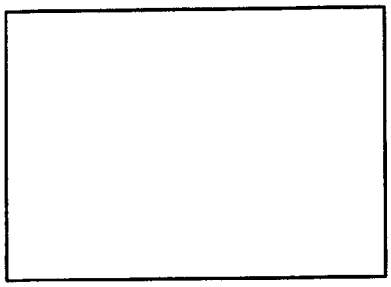
FIGS. 6(*a*)–6(*e*) show image patterns to evaluate discrimination.
Figure 6B:
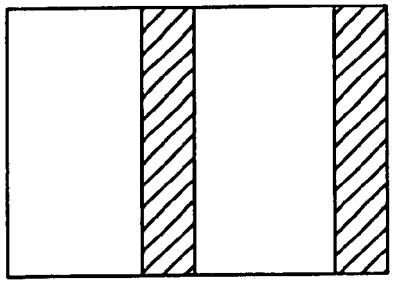
Figure 6C:
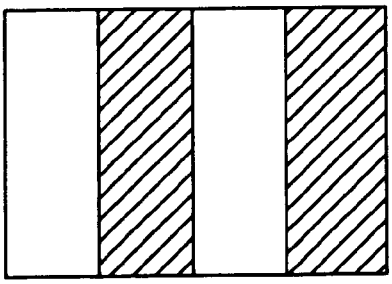
Figure 6D:
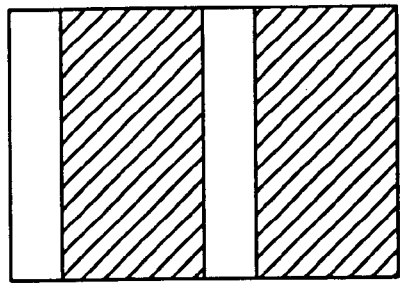
Figure 6E:
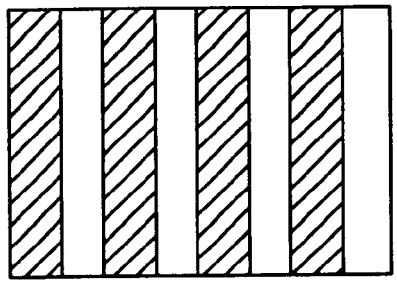
Figure 7:
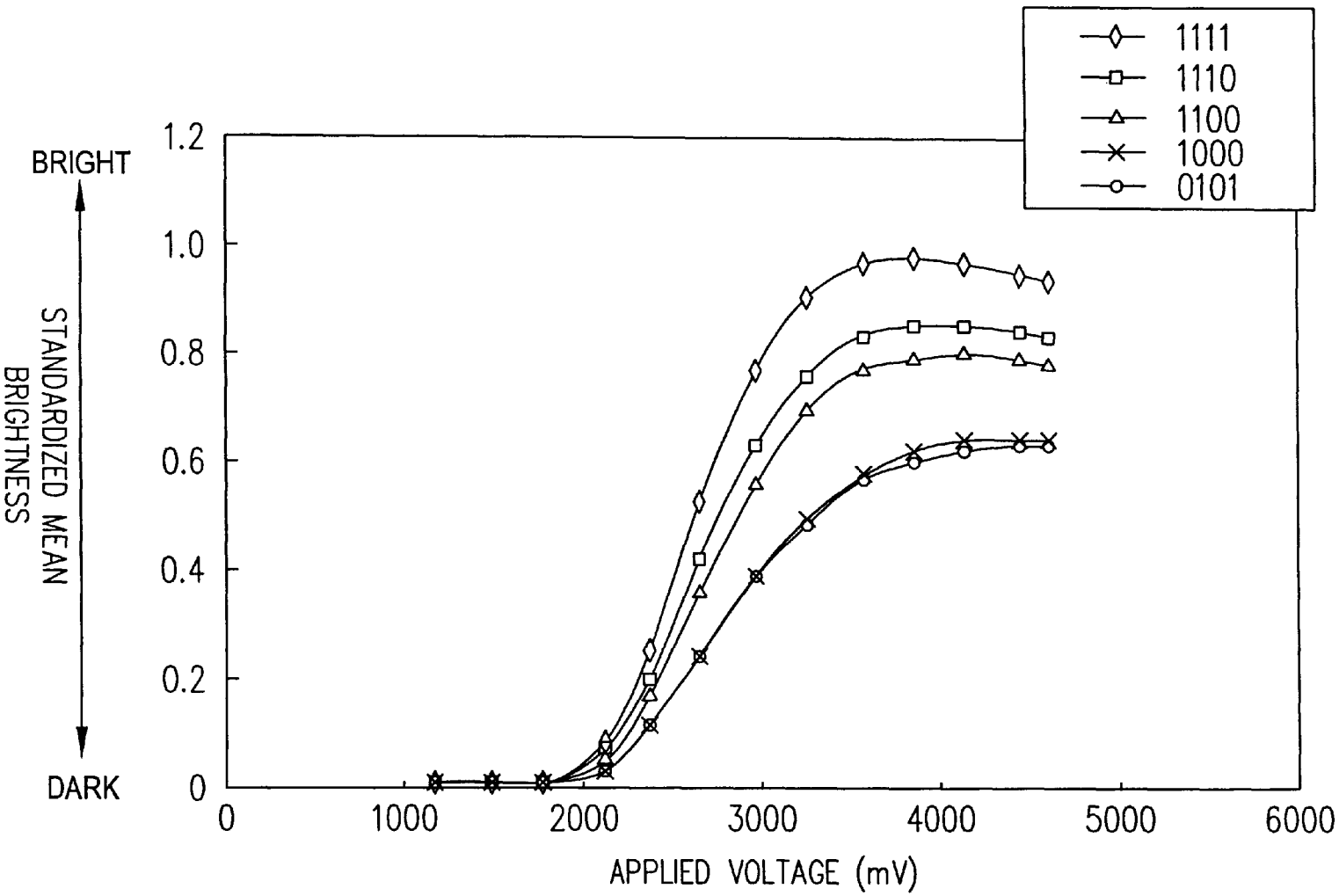
FIG. 7 is a graph showing the relationships between standardized brightness values of a pixel and applied voltage for image patterns.

FIG. 4 is a block diagram of the operation processing of the computing block 120 in actual use of the notebook computer 10. The CPU 121 uses all the surrounding pixels P1, P2, . . . through P8, which surround the object pixel P0, by which the operation processing is done from pixel data input to the computing block 120 (step S71).

Next, CPU 121 selects one pixel Pn, which surrounds the object pixel P0 from P1, P2 . . . through P8 (steps S72 and S73). After pixel selection ends, a pixel value Pn' is subtracted from P0' of the object pixel P0, and the CPU 121 judges the obtained difference value (step S74).

For a normally black-type liquid crystal display, assuming a pixel value of a black pixel to be zero and a pixel value of a white pixel to be ten, if P0' minus Pn' is a positive value, then pixel P0 has an effect of discrimination by pixel Pn. However, if the difference P0' minus Pn' is zero or negative, then the discrimination is negligible.

When the obtained difference value is zero or a negative value, the next pixel P(n+1) is selected (step S74), as it is not necessary to take into account the discrimination. When the obtained difference value is positive, the coefficient Kn is multiplied by the difference value (step S75).

The multiplied values in step S75 are summed up (step S76).

The above-described processing is repeated for all of the surrounding pixels, P1, P2, . . . P8 (step S77).

Thus, a new pixel value P0''' of the object pixel P0 is calculated. If all the difference is a positive value, the new pixel value P0''' can be expressed numerically as follows.

$$P0''' = P0' + \sum_{n=1}^{8} (P0' - Pn')Kn \tag{1}$$

Such an operation is performed, over all of the pixels P that compose the two-dimensional image 20, one by one.

In the embodiment described above, the operation is done by software. However, it is preferable to process the above-described operation using a suitable hardware circuit to improve the processing speed in the liquid crystal display, which displays moving pictures or animations, such as a liquid crystal television display.

The pixel data processed in the computing block 120 is output to the gamma corrector 160 and gamma corrected, and is then input to the phase inverter driving buffer 200. Display apparatus 300 includes a data signal circuit 310, a scanning signal circuit 320, and a liquid crystal display panel 330. Processed pixel data to which the polarity of the voltage applied to the liquid crystal display panel 330 is reversed is supplied to a data signal circuit 310 by the phase inverter driving buffer 200. The data signal circuit 310 applies the voltage of processed pixel data to the liquid crystal display panel 330 according to the timing of the control signal input from the timing generator 400. The scanning signal circuit 320 supplies the scanning signal to liquid crystal display panel 330 according to the timing of the control signal input from the timing generator 400 and scans the liquid crystal display panel 330. As a result, an image is displayed on the liquid crystal display panel 330.

In other embodiments, the liquid crystal display control device of this invention can be applied also to a liquid crystal display, which has a liquid crystal display panel of a horizontal orientation-type liquid crystal. On a normally-white horizontal alignment liquid crystal display, the relation between the penetration or interception of a beam and the application or non-application of the voltage becomes contrary to the relation of notebook computer 10 in the above-described embodiment.

Therefore, if P0'−Pn'<0, the coefficient is set to Kn, and if P0'−Pn' ≧0, the coefficient is set to Kn'. A new pixel value P0''' of object pixel P0 can be expressed the same as the above-described expression (1), when each difference value is all negative.

Also, in the embodiments described above, the difference of the pixel value Pn' of pixel Pn is subtracted from P0' and compared to zero. The difference threshold can be other than zero, such as, e.g., 1.0 or −0.5.

Moreover, liquid crystal display control devices of this invention can be used not only to address discrimination, or to reduce the influence received from surrounding pixels of two-dimensional images.

In addition, this invention is not limited to liquid crystal display control devices, and is applicable in various image control devices.

Moreover, liquid crystal displays of this invention are not limited to a notebook computer, and can be applied also, e.g., to a projection-type liquid crystal display and a liquid crystal television display.

As described above, by controlling pixel values of pixels influenced by surrounding pixels of two-dimensional images, the influence of the surrounding pixels is reduced in the display devices and a display control device can be provided.

Although the invention has been described with respect to specific embodiments for complete and clear disclosure, the appended claims are not to be thus limited, but are to be construed as embodying all modification and alternative constructions that may occur to one skilled in the art which fall within the basic teachings set forth herein.

What is claimed is:

1. A liquid crystal display control device comprising:

a data input port at which pixel data of a plurality of pixels forming a two-dimensional image is input; and a liquid crystal display control device that:

(a) associates a first element with a first pixel of the two-dimensional image;

(b) associates each of a plurality of second elements with respective ones of a plurality of second pixels surrounding the first pixel of the two-dimensional image;

(c) sets a coefficient for each second element, corresponding to a difference value between each second pixel value of each second pixel and a pixel value of the first pixel;

(d) multiplies the coefficient set for the second element of each second pixel by the difference value between the second pixel value of each second pixel and the pixel value of the first pixel;

(e) adds all of the multiplication results of the plurality of second pixels;

(f) generates a new processed pixel value corresponding to the first pixel; and (g) sets the first pixel to one pixel of the plurality of pixels of the two-dimensional image and performs (a)–(f) for each pixel of the two-dimensional image one-by-one.

2. The liquid crystal display control device according to claim 1, wherein the coefficient corresponding to each difference value is set to a fixed threshold.

3. The liquid crystal display control device according to claim 2, wherein the threshold is zero.

4. A liquid crystal display apparatus, comprising:

a data input port at which pixel data of a plurality of pixels forming a two-dimensional image is input;

a liquid crystal display control device that:

(a) associates a first element with a first pixel of the two-dimensional image;

(b) associates each of a plurality of second elements with respective ones of a plurality of second pixels surrounding the first pixel of the two-dimensional image;

(c) sets a coefficient for each second element, corresponding to a difference value between each second pixel value of each second pixel and a pixel value of the first pixel;

(d) multiplies the coefficient set for the second element of each second pixel by the difference value between the second pixel value of each second pixel and the pixel value of the first pixel;

(e) adds all of the multiplication results of the plurality of second pixels;

(f) generates a new processed pixel value corresponding to the first pixel; and (g) sets the first pixel to one pixel of the plurality of pixels of the two-dimensional image and performs (a)–(f) for each pixel of the two-dimensional image one-by-one; and a display panel that displays the two-dimensional image based on processed pixel data obtained by (a)–(g).

5. The liquid crystal display apparatus according to claim 4, wherein when a sign of the difference value of the second pixel value of the second pixel subtracted from the first pixel value of the first pixel is positive, a larger coefficient is adopted as compared to when the sign of the difference value is negative.

6. The liquid crystal display apparatus according to claim 5, wherein when the sign of the difference value of the second pixel value of the second pixel subtracted from the first pixel value of the first pixel is negative, the coefficient is set to zero.

7. The liquid crystal display apparatus according to claim 4, wherein the liquid crystal display apparatus is a projection-type display.

8. The liquid crystal display apparatus according to claim 7, wherein the liquid crystal display apparatus is a liquid crystal projector or a liquid crystal television set.

9. The liquid crystal display apparatus according to claim 5, wherein the liquid crystal display apparatus is a projection-type display.

10. The liquid crystal display apparatus according to claim 9, wherein the liquid crystal display apparatus is a liquid crystal projector or a liquid crystal television set.

11. The liquid crystal display apparatus according to claim 6, wherein the liquid crystal display apparatus is a projection-type display.

12. The liquid crystal display apparatus according to claim 11, wherein the liquid crystal display apparatus is a liquid crystal projector or a liquid crystal television set.

13. A spatial filtering method, comprising:

determining each difference value of a second pixel value of each of a plurality of second pixels subtracted from a first pixel value of a first pixel;

setting a coefficient corresponding to each difference value determined by subtracting the second pixel value of each second pixel from the first pixel value of the first pixel, respectively;

multiplying the coefficient set corresponding to each second pixel by the difference value determined by subtracting the second pixel value of each second pixel from the first pixel value of the first pixel;

generating a renewed first pixel value of the first pixel by adding the multiplication results of each of the second pixels; and selecting the first pixel in the two-dimensional image one-by-one.

14. The spatial filtering method according to claim 13, wherein the coefficient is set to an optimum value corresponding to the difference value.

15. The spatial filtering method according to claim 13, wherein the coefficient is set to an optimum value corresponding to a usage of a display apparatus.

* * * * *